US005106324A

United States Patent [19]

Natsume

[11] Patent Number: 5,106,324

[45] Date of Patent: Apr. 21, 1992

[54] JOINT TERMINAL

[75] Inventor: Yoshihisa Natsume, Shizuoka, Japan

[73] Assignee: Yazaki Corporation, Tokyo, Japan

[21] Appl. No.: 721,859

[22] Filed: Jun. 26, 1991

[30] Foreign Application Priority Data

Jun. 27, 1990 [JP] Japan ..... 2-67254[U]

[51] Int. Cl.[5] ..... H01R 31/08

[52] U.S. Cl. ..... 439/510; 439/512; 439/513; 439/621

[58] Field of Search ..... 439/65, 507, 510, 512, 439/513, 621, 907

[56] References Cited

U.S. PATENT DOCUMENTS 4,992,062 2/1991 Nakayama et al. ..... 439/621

FOREIGN PATENT DOCUMENTS 56-4185 1/1981 Japan .
56-4186 1/1981 Japan .
57-39902 9/1982 Japan .
63-73869 5/1988 Japan .
1-41183 12/1989 Japan .

*Primary Examiner*—Paula A. Bradley

*Attorney, Agent, or Firm*—Armstrong, Nikaido, Marmelstein, Kubovick & Murray

[57] ABSTRACT

A joint terminal including: a fixed contact plate having side plates at both sides thereof; a first resilient contact plate integrally formed with the fixed contact plate and formed by folding the fixed contact plate from one end thereof to the other end via a stiff bent portion; an enclosing plate integrally formed with the fixed contact plate and extending from said side plates of the fixed contact plate over the first resilient contact plate to enclose the first resilient contact plate; and a second resilient contact plate integrally formed with the enclosing plate and formed by folding the enclosing plate at one end thereof on the stiff bent portion side via a bent portion, the second resilient contact plate being opposed to the first resilient contact plate, wherein one of two male terminals are inserted between the fixed contact plate and the first resilient contact plate, and the other male terminal is inserted between the first and second resilient contact plates in the opposite direction from which the one male terminal is inserted. The joint terminal is useful for connecting tabs of bus bars constituting internal circuit and male terminals of electric parts for automobiles.

6 Claims, 8 Drawing Sheets

JOINT TERMINAL

BACKGROUND OF THE INVENTION

1. Field of the Invention

The present invention relates to a joint terminal in an electric junction box for connecting electric circuit for automobiles, and more particularly, to a joint terminal for connecting tabs of bus bars, which constitutes internal circuit, and male terminals of electric parts such as a fuse.

2. Description of the Prior Art

This type of joint terminal conventionally used is shown in FIGS. 7 and 10 (Japanese Utility Model Publication Number Showa 57-39902).

This joint terminal a has a body comprising: a fixed contact plate b; a resilient contact portion c integrally formed with the resilient contact plate b and formed by folding the fixed contact plate from one end thereof to the other end; and a pair of resilient contact arms integrally formed with the fixed contact plate b and extending from both ends thereof over the resilient contact portion c. The contact arms d oppose each other, of which end portions are bent in such a manner as to form inwardly turned half-round are portions and of which tips oppose each other over the resilient contact portion c at certain intervals.

As exemplified in FIG. 11, the joint terminal is inserted in a fixed cavity f of an electric junction box e. Then, a tab j of a bus bar i is inserted from the underside between the resilient contact portion c and the half-round are portion d' and a male terminal h of the fuse g is inserted from the upper side.

In the conventional joint terminal, as shown in FIG. 12A, the structure of the terminal is designed such that dimensional tolerance or variation in plate thickness of the male terminal h, the resilient arms d and tab j, is absorbed through the half-round are portions d', resulting in difficulty in obtaining stable contact load.

That is, the tab j is occasionally diagonally inserted as illustrated in FIG. 12B, causing deformation to the half-round are portion d'. Further, the deformation not only causes line contact between the half-round are portion d' and the tab j but also causes excessive stress over an allowable stress of the half-round are portion d' which is used as a spring, resulting in unstable electric contact. On the other hand, in order to design in such a manner that the stress of the spring is maintained within an allowable stress range, the radius of the half-round are portion d' needs to be rather large, which cannot structurally regulate the twist of the tab j at insertion.

SUMMARY OF THE INVENTION

The present device has been made in view of the foregoing problem, and hence it is an object of the present device to provide a joint terminal in which when male terminals (tabs) are inserted, the risk of deformation and twist of the male terminals is eliminated and the structure ensures stable contact load.

To achieve the object, the present device provides a joint terminal, comprising: a first resilient contact plate integrally formed with a fixed contact plate and formed by folding the fixed contact plate from an end to the other end thereof via a stiff bent portion; an enclosing plate integrally formed with the fixed contact plate via side plates at both ends thereof to enclose the first resilient contact plate; and a second resilient contact plate integrally formed with the enclosing plate and formed by folding the enclosing plate at an end thereof on the stiff bent portion side, the second resilient contact plate being opposed to the first resilient contact plate, one of two male terminals being inserted between the fixed contact plate and the first resilient contact plate, and the other being inserted between the first and second resilient contact plates in the opposite direction from which the one male terminal is inserted.

BRIEF DESCRIPTION OF THE DRAWINGS

The foregoing object and advantages will be better understood from the following description with reference to the accompanying drawings, in which.

DETAILED DESCRIPTION OF PREFERRED EMBODIMENTS

Figure 1:
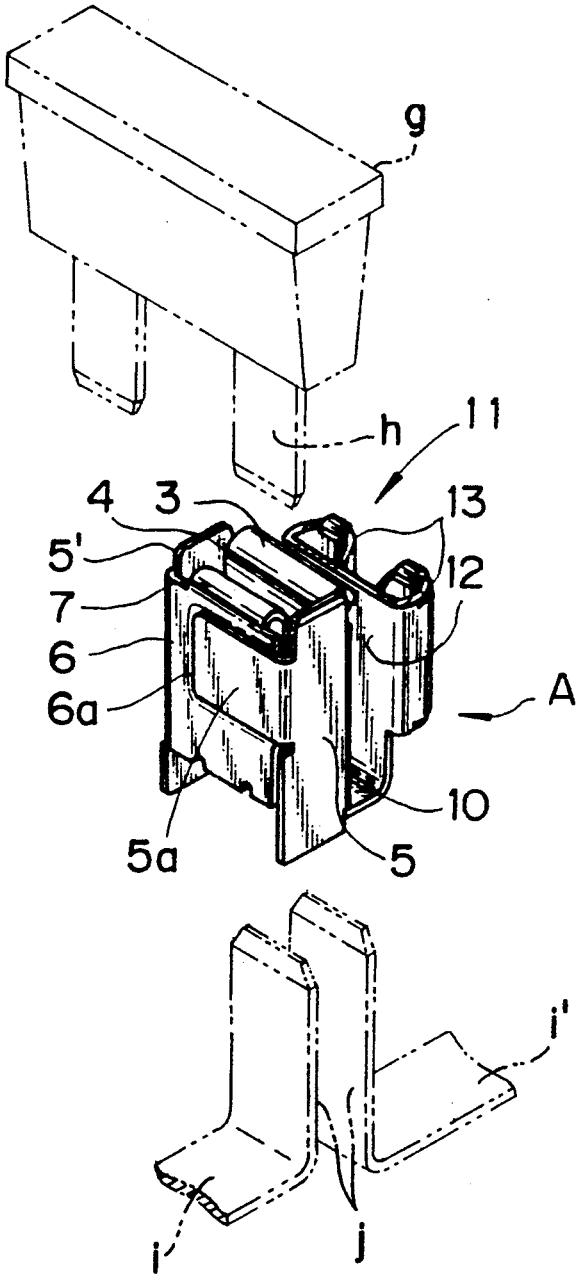
FIG. 1 is a perspective view of the joint terminal according to one embodiment of the present device.
Figure 2:
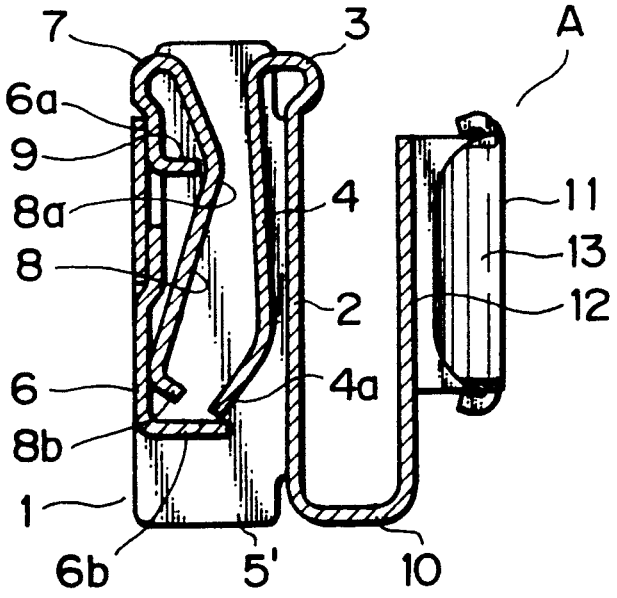
FIG. 2 is a vertical mid-sectional drawing of the joint terminal shown in FIG. 1.
Figure 3:
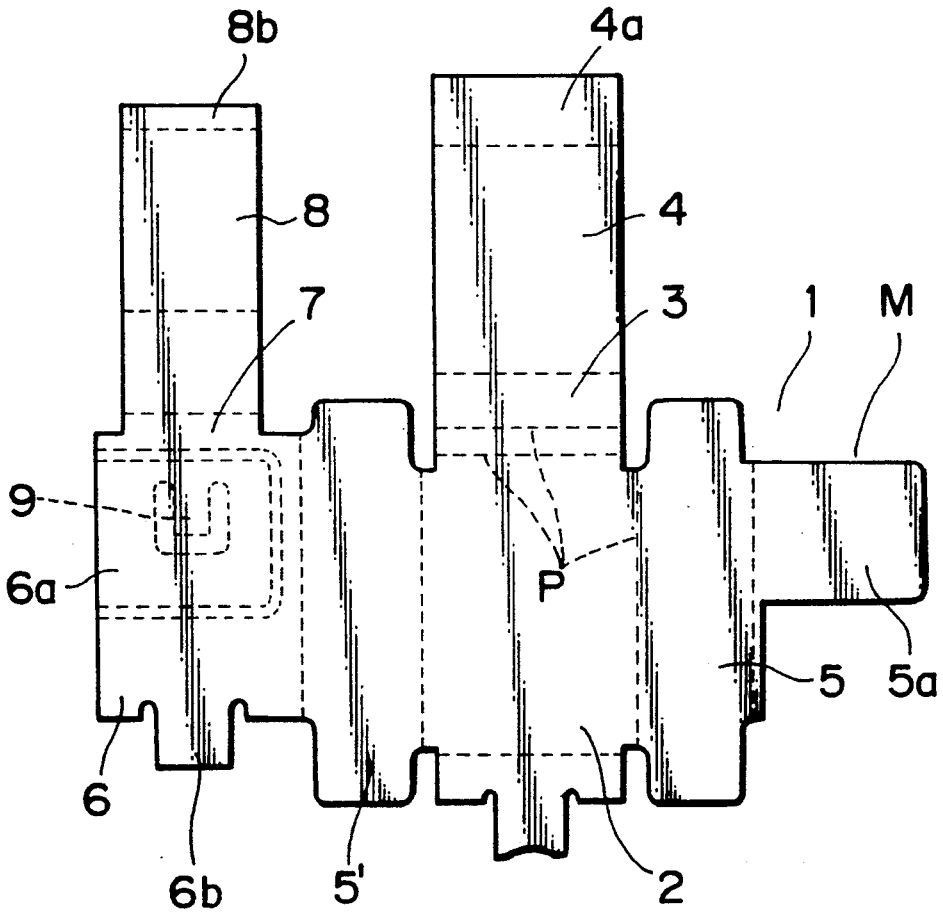
FIG. 3 is a development of the joint terminal shown in FIG. 1.

As shown in FIGS. 1 to 3, a joint terminal A is formed by connecting a joint terminal body 1 with a connecting portion 10 to a female terminal portion 11.

The joint terminal body 1 is provided with a first resilient contact plate 4 integrally formed with a fixed contact plate 2 and formed by folding the fixed contact plate at one end thereof to the other end via a stiff bent portion 3. This first resilient contact plate 4 is enclosed by an enclosing plate 6 which is formed via side plates 5 and 5' at both ends of the fixed contact plate 2. A second resilient contact plate 8 is integrally formed with the enclosing plate 6 and formed by folding the plate at an end on the stiff bent portion side 3 via a half-round arc portion 7 while being opposed to the first resilient contact plate 4.

The female terminal portion 11 comprises a second fixed contact plate 12 opposing the fixed contact plate 2 via the connecting portion 10 at the lower end of the plate 2, and resilient fitting arms 13 and 13 of which end portions are bent inwardly to oppose the end portions of each other. This female portion 11 is arbitrarily provided as occasion demands.

Figure 4:
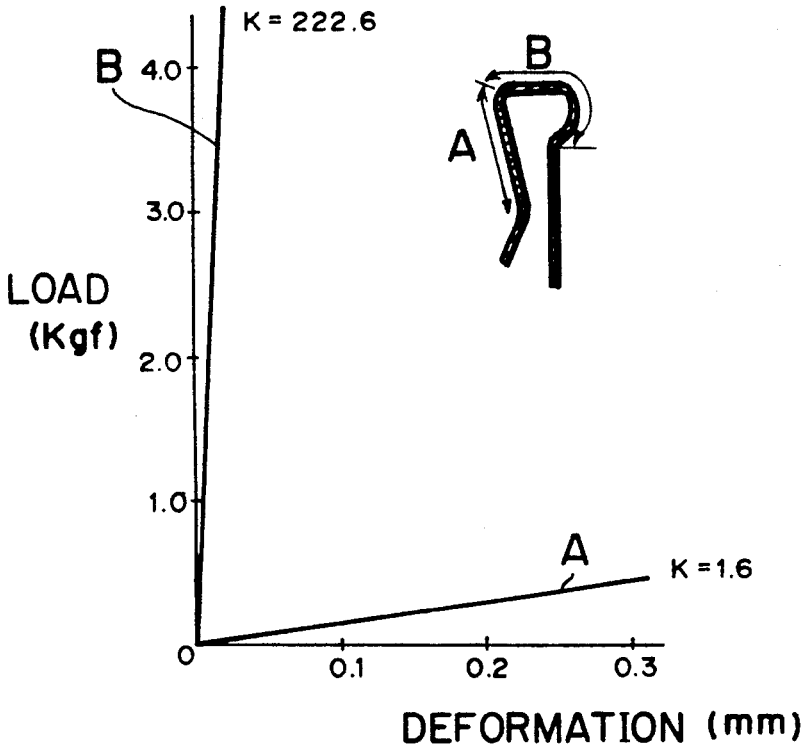
FIG. 4 illustrates design values of the elastic modulus of beam A and B of the stiff bent portion 3 and the first resilient contact plate.

The first resilient contact plate 4 is inclined to the fixed contact plate 2 side, as shown in FIG. 2, and is provided with a guide portion 4a at lower portion thereof. FIG. 4 indicates design values of beams A and B of the first resilient contact plate 4 and the stiff bent portion 3. As apparent from the figure, the beam A is formed with elastic modulus considerably lower than that of the beam B so that the stiff bent portion 3 is not deformed by external force, which provides such structure that the first resilient contact plate 4 is susceptible to deformation.

The second resilient contact plate 8 is folded in such a manner as to have the shape of the angle with apex 8a, and at the lower portion thereof is provided with a reaction piece 8b. Further, the enclosing plate 6 is provided at the intermediate portion thereof with a struckout 6a and is provided at the lower portion thereof with a mis-insertion protection piece 6b. At the struckout, a regulation piece 9 is integrally formed with the struckout and formed by bending one end thereof to prevent the second resilient contact plate 8 from excessive deflection over an elastic limit. The mis-insertion protection piece 6b is formed such that a tip thereof is adjacent to the guide portion 4a of the first resilient contact plate 4, preventing a tab of a bus bar from being accidentally inserted between the first and second resilient contact plates 4 and 8.

As exemplified in a development of FIG. 3, the joint terminal is formed by folding a base plate M punched from conductive metal plate at dotted lines P. In the figure, 5a denotes an overlapping fixed plate which holds the struckout 6a from the outside.

Next, the use of the joint terminal A will be explained.

Figure 5:
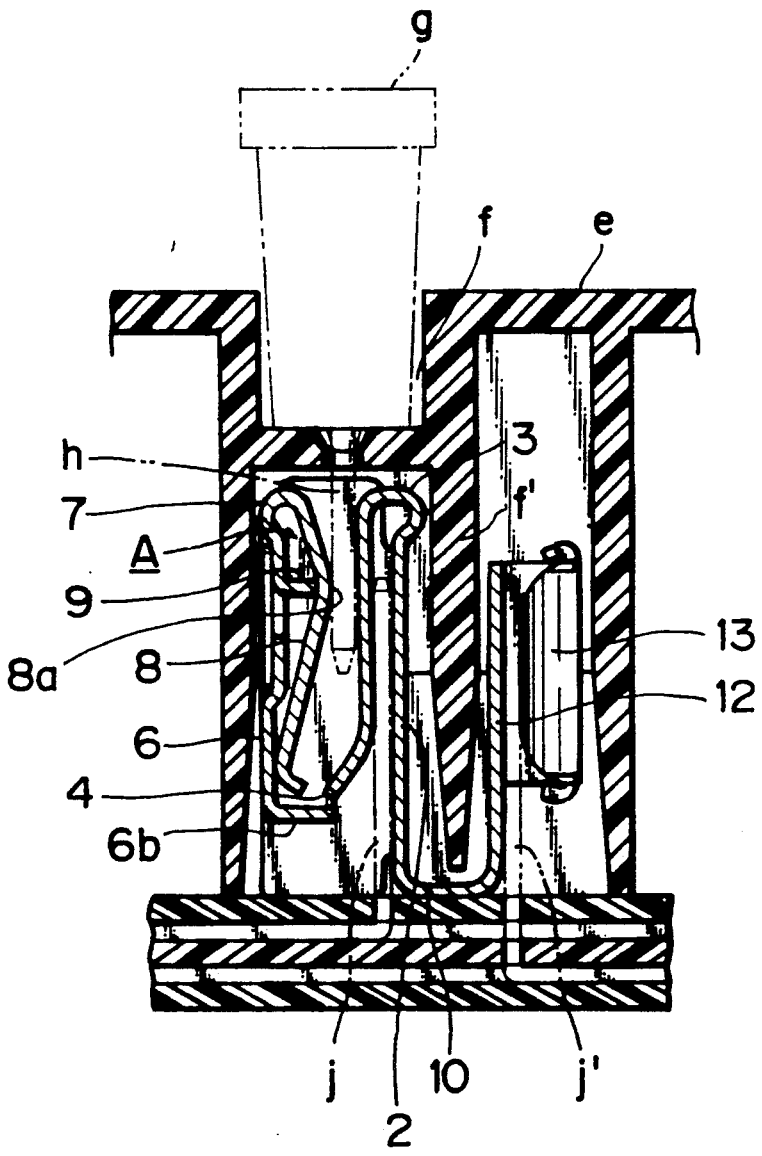
FIG. 5 is a sectional drawing of the joint terminal in operation.

As shown in FIG. 5, the joint terminal A is inserted in cavities f of an electric junction box body e and the tab j of bus bar i is inserted from the underside between the fixed contact plate 2 and the first resilient contact plate 4.

Figure 6A:
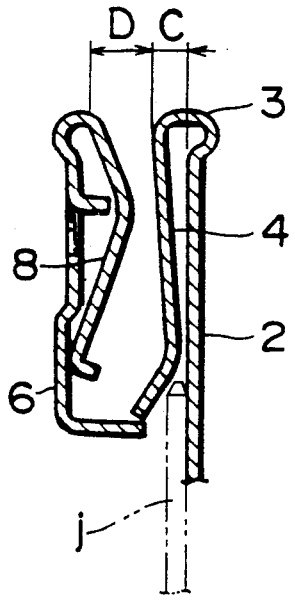
FIGS. 6A to 6C are sectional drawings showing a primary portion of the first and second resilient contact plates in operation.
Figure 6B:
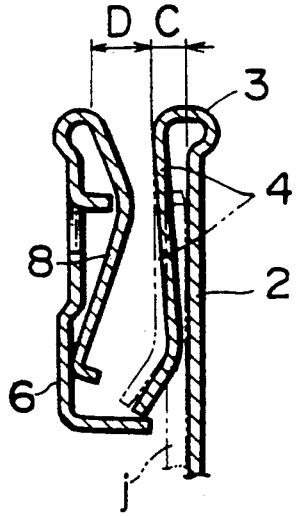
Figure 6C:
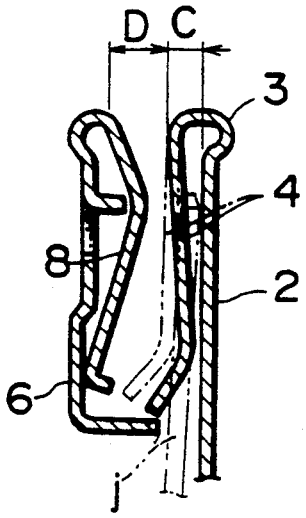
Figure 7:
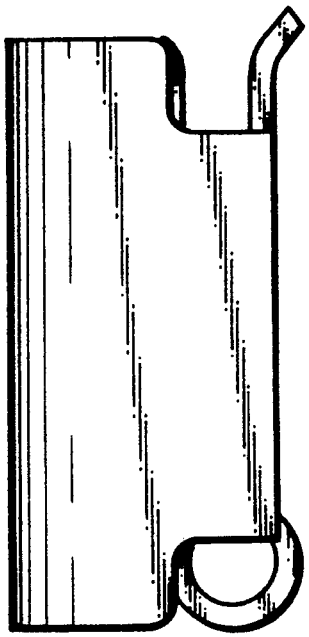
FIG. 7 PRIOR ART
FIG. 7 is a right side view of a conventional joint terminal.
Figure 8:
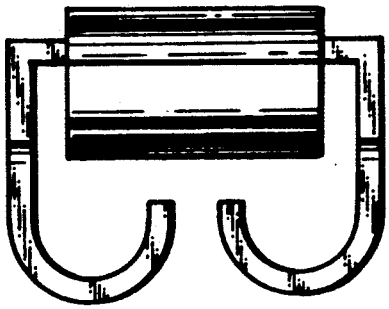
FIG. 8 PRIOR ART
FIG. 8 is a plan view of the conventional joint terminal shown in FIG. 7.
Figure 9:
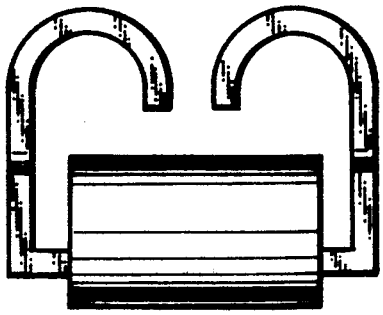
FIG. 9 PRIOR ART
FIG. 9 is a bottom plan view of the conventional joint terminal shown in FIG. 7.
Figure 10:
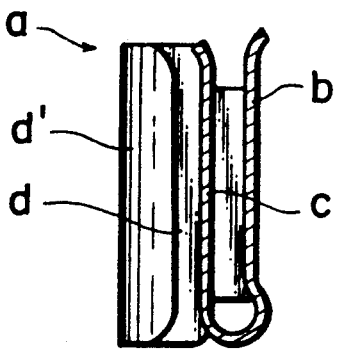
FIG. 10 PRIOR ART
FIG. 10 is a vertical mid-sectional view of the conventional joint terminal shown in FIG. 7.
Figure 11:
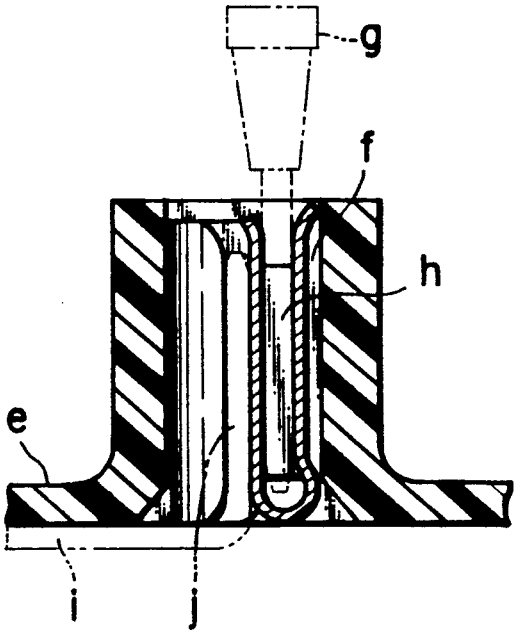
FIG. 11 PRIOR ART
FIG. 11 is a sectional view of the conventional joint terminal shown in FIG. 7 in operation.
Figure 12A:
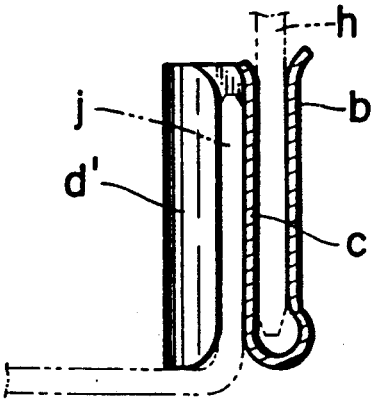
FIG. 12A PRIOR ART
FIGS. 12A and 12B are drawings for explaining an operation condition of the joint terminal shown in FIG. 7.
Figure 12B:
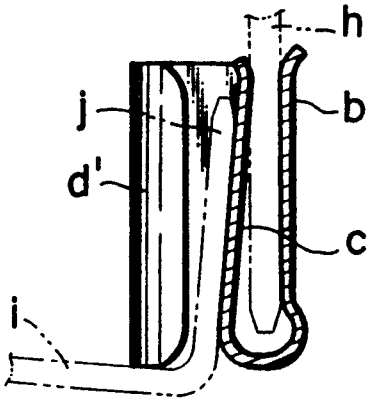
FIG. 12B PRIOR ART
Figure 5:
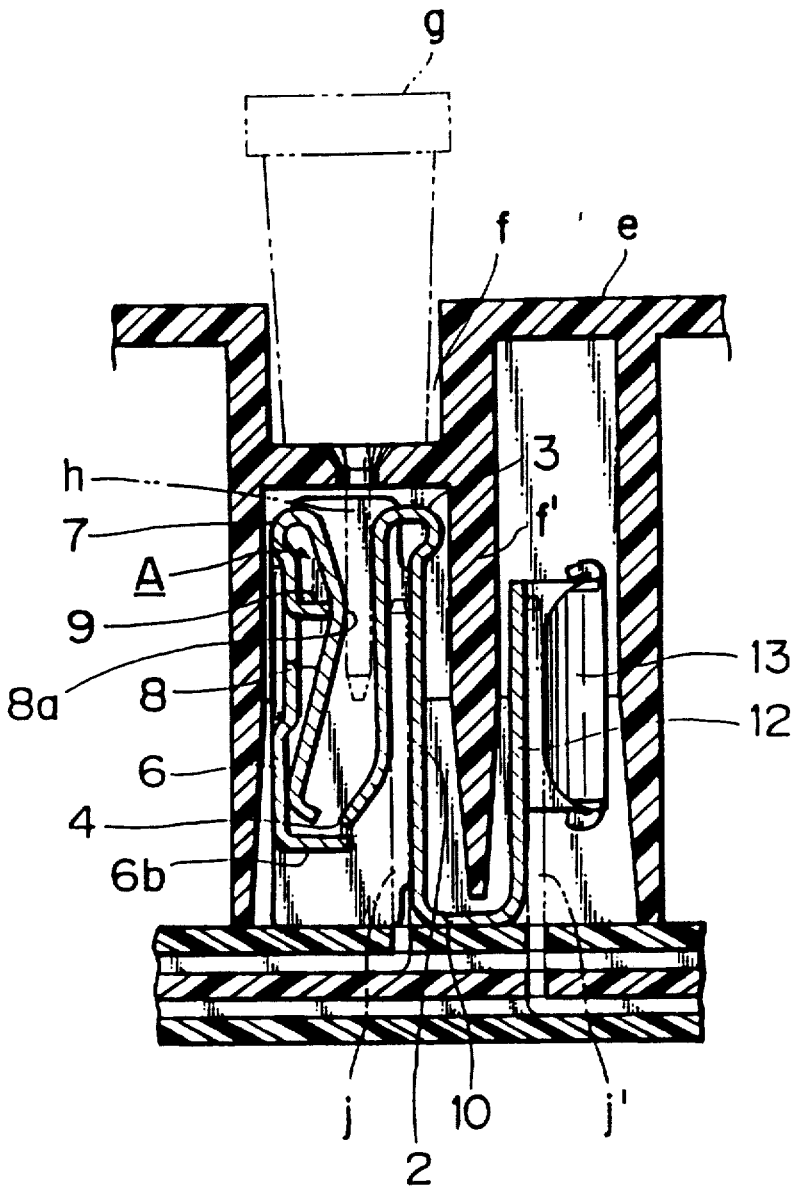

When the tab j is inserted, the first resilient contact plate 4 is externally resiliently deformed about the stiff bent portion 3 as a fulcrum and the plate 4 contacts the tab j in parallel, as shown in FIGS. 6A and 6B. Further, as illustrated in FIG. 6C, even when the tab j is diagonally inserted with respect to the fixed contact plate 2, the first resilient contact plate 4 is deformed with the tab j, which makes the position of the plate parallel to the tab.

In other words, regardless of the inserted position of the tab j, external dimension C of the stiff bent portion 3 does not change due to its stiff structure and the inlet distance D between the stiff bent portion and the second resilient contact plate 8 is maintained substantially constant. By virtue of the mis-insertion protection piece 6b, there is no probability that the tab j will be accidentally inserted between the first and second resilient contact plates 4 and 8.

Then, when the male terminal h is inserted between the first resilient contact plate 4 and the second resilient contact plate 8, the male terminal h is urged by the apex 8a of the second resilient contact plate 8 to come in face-contact with the plate 4 in parallel, permitting stable electric connection.

Since the joint terminal A in the figure is provided with another female terminal portion 11, a tab j' of another bus bar i' can be connected at the same time. The cavity f is provided with a heat interference protection wall f' to protect the two electric contact portions (joint terminal body 1 and the female terminal portion 11) from being influenced by electric heat each other.

Meanwhile, since the joint terminal body 1 has a stiff frame structure comprising the fixed contact plate 2, the side plates 5 and 5', and the enclosing plate 6, even if the position of the male terminal h or the tab j is inclined at insertion, or somewhat large force is applied to the body, the body is less susceptible to change in external shape. Further, the second resilient contact plate 8 does not receive excessive load over an allowable stress due to the protection of the regulation piece 9, permitting mechanical and electrical stability.

As explained above, the present device provides a joint terminal in which there is no risk of deformation or the twist of the male terminals at insertion; stable contact load is obtained; and electrical and mechanical properties thereof are improved.

What is claimed is:

1. A joint terminal comprising:

a fixed contact plate having side plates at both sides thereof;

a first resilient contact plate integrally formed with said fixed contact plate and formed by folding the fixed contact plate from one end thereof to the other end via a stiff bent portion; p1 an enclosing plate integrally formed with said fixed contact plate and extending from said side plates of the fixed contact plate over the first resilient contact plate to enclose the first resilient contact plate; and a second resilient contact plate integrally formed with said enclosing plate and formed by folding the enclosing plate at one end thereof on the stiff bent portion side via a bent portion, the second resilient contact plate being opposed to the first resilient contact plate, wherein one of two male terminals are inserted between the fixed contact plate and the first resilient contact plate, and the other male terminal is inserted between the first and second resilient contact plates in the opposite direction from which the one male terminal is inserted.

2. A joint terminal as claimed in claim 1, wherein said second resilient contact plate comprises: an angle portion having an apex, and a reaction piece integrally formed with the second resilient contact plate and formed by folding one end thereof on the side opposing to the bent portion.

3. A joint terminal as claimed in claim 1, wherein the elastic modulus of said stiff bent portion is larger than the elastic modulus of said first resilient contact plate.

4. A joint terminal as claimed in claim 1, wherein said enclosing plate is provided with a regulation piece integrally formed with the enclosing plate and extending from one end thereof on the side opposing to the bent portion over an opening between the first resilient contact plate and the second resilient contact plate.

5. A joint terminal as claimed in claim 1, wherein said fixed contact plate is provided with a female terminal portion integrally formed with the fixed contact plate at one end thereof on the side opposing to the stiff bent portion via a connecting plate.

6. A joint terminal as claimed in claim 5, wherein said female terminal portion comprises a fixed contact plate and resilient fitting arms integrally formed with the fixed contact plate and extending from both ends of the fixed contact plate to bend inwardly.

* * * * *

UNITED STATES PATENT AND TRADEMARK OFFICE

CERTIFICATE OF CORRECTION

PATENT NO. : 5,106,324

DATED : April 21, 1992

INVENTOR(S) : Yoshihisa Natsume

It is certified that error appears in the above-identified patent and that said Letters Patent is hereby corrected as shown below:

On the title page, replace the drawing with the attached Fig. 5.

Signed and Sealed this

Twenty-first Day of September, 1993

Bruce Lehman

*Attest:*

BRUCE LEHMAN

*Attesting Officer*

*Commissioner of Patents and Trademarks*

US005106324A

United States Patent [19]

Natsume

[11] Patent Number: 5,106,324

[45] Date of Patent: Apr. 21, 1992

[54] JOINT TERMINAL

[75] Inventor: Yoshihisa Natsume, Shizuoka, Japan

[73] Assignee: Yazaki Corporation, Tokyo, Japan

[21] Appl. No.: 721,859

[22] Filed: Jun. 26, 1991

[30] Foreign Application Priority Data

Jun. 27, 1990 [JP] Japan ..... 2-67254[U]

[51] Int. Cl.[5] ..... H01R 31/08

[52] U.S. Cl. ..... 439/510; 439/512; 439/513; 439/621

[58] Field of Search ..... 439/65, 507, 510, 512, 439/513, 621, 907

[56] References Cited

U.S. PATENT DOCUMENTS 4,992,062 2/1991 Nakayama et al. ..... 439/621

FOREIGN PATENT DOCUMENTS 56-4185 1/1981 Japan .
56-4186 1/1981 Japan .
57-39902 9/1982 Japan .
63-73869 5/1988 Japan .
1-41183 12/1989 Japan .

*Primary Examiner*—Paula A. Bradley

*Attorney, Agent, or Firm*—Armstrong, Nikaido, Marmelstein, Kubovick & Murray

[57] ABSTRACT

A joint terminal including: a fixed contact plate having side plates at both sides thereof; a first resilient contact plate integrally formed with the fixed contact plate and formed by folding the fixed contact plate from one end thereof to the other end via a stiff bent portion; an enclosing plate integrally formed with the fixed contact plate and extending from said side plates of the fixed contact plate over the first resilient contact plate to enclose the first resilient contact plate; and a second resilient contact plate integrally formed with the enclosing plate and formed by folding the enclosing plate at one end thereof on the stiff bent portion side via a bent portion, the second resilient contact plate being opposed to the first resilient contact plate, wherein one of two male terminals are inserted between the fixed contact plate and the first resilient contact plate, and the other male terminal is inserted between the first and second resilient contact plates in the opposite direction from which the one male terminal is inserted. The joint terminal is useful for connecting tabs of bus bars constituting internal circuit and male terminals of electric parts for automobiles.

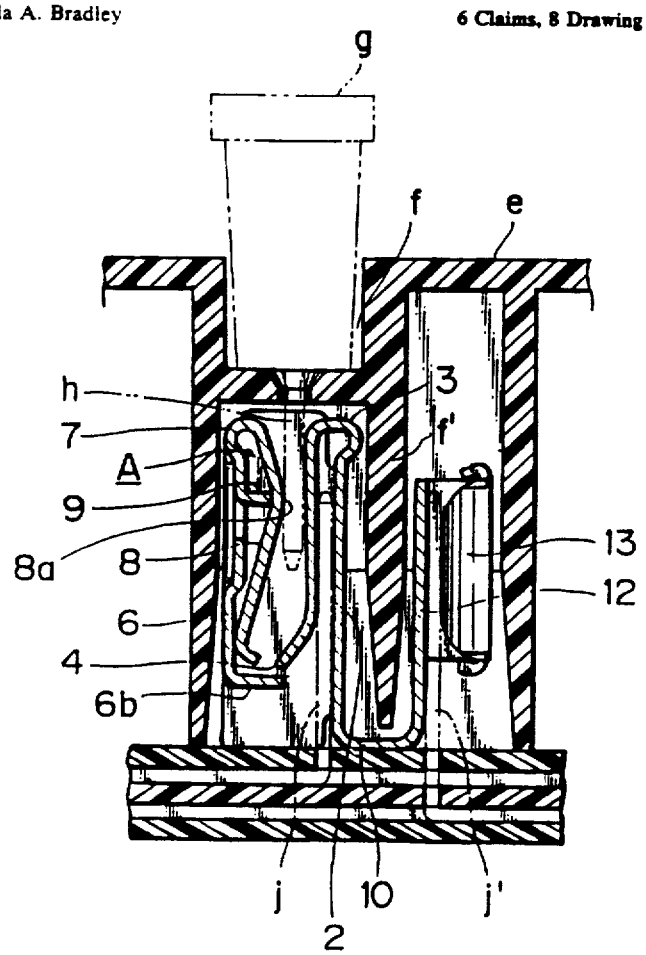

6 Claims, 8 Drawing Sheets